United States Patent [19]

Moses

[11] Patent Number: 4,662,697

[45] Date of Patent: May 5, 1987

[54] SAFETY DEVICE FOR ELECTRICAL OUTLET

[76] Inventor: Paul Moses, 187 South St., Needham, Mass. 02192

[21] Appl. No.: 865,149

[22] Filed: May 20, 1986

[51] Int. Cl.[4] ..... H01R 13/639

[52] U.S. Cl. ..... 339/38; 174/67; 339/39; 339/75 P; 339/82; 339/106

[58] Field of Search ..... 339/36, 38, 39, 75 P, 339/103 R, 103 M, 106, 82, 77–79; 174/66, 67

[56] References Cited

U.S. PATENT DOCUMENTS

| | | | |
|---|---|---|---|
| 2,659,059 | 11/1953 | Johnson | 339/75 P |
| 2,932,811 | 4/1960 | Abraham et al. | 339/38 |
| 3,538,484 | 11/1970 | Passafiume | 339/75 P |
| 3,811,104 | 5/1974 | Caldwell | 339/39 |
| 4,105,274 | 4/1977 | Casey | 339/75 P |
| 4,424,407 | 11/1981 | Barbic | 174/67 |
| 4,530,555 | 6/1983 | South | 339/39 |

*Primary Examiner*—Gil Weidenfeld
*Assistant Examiner*—Steven C. Bishop

[57] ABSTRACT

Removal of an electrical plug from one socket of a multi-socket outlet is resisted by a device that includes a retainer portion having a least one prong that is inserted into a second socket of the outlet and cooperates with the socket to resist removal of the retainer portion, and an arm portion that is connected to the retainer portion and obstructs removal of the plug from the one socket. The arm portion is rigid enough to prevent removal of the plug except by also removing the retainer portion.

8 Claims, 3 Drawing Figures

SAFETY DEVICE FOR ELECTRICAL OUTLET

BACKGROUND OF THE INVENTION

This invention relates to safety devices for electrical outlets.

In order to prevent children from experiencing electrical shock from such an outlet, it is common to plug a non-conductive plastic fitting into an empty socket of the outlet. The fitting is arranged to be held too snugly to be removed by the child. Another device, described by Casey (U.S. Pat. No. 4,105,274), has arms that are secured to the outlet by a screw; the arms extend over electrical plugs inserted into the sockets of the outlet and prevent the plugs from being removed except by use of a screwdriver.

SUMMARY OF THE INVENTION

The invention features a device for resisting the removal of an electrical plug from one socket of an electrical outlet of the kind that has a plurality of sockets. The device has a retainer portion with at least one prong for insertion into a second socket of the outlet. The prong cooperates with the socket to resist removal of the retainer portion. Connected to the retainer is an arm portion that is arranged to obstruct removal of the plug from the first socket. The arm portion has sufficient rigidity to prevent removal of the plug except by also removing the retainer portion.

Preferred embodiments include the following features. The electrical plug has a surface facing away from the outlet, and the arm portion has a surface that faces the outlet and cooperates with the electrical plug surface to obstruct the removal. The prong of the retainer portion is held tightly by friction in the second socket. The arm portion includes a plate that has a slot for seating a cord attached to the plug and a means for holding the cord in the slot. The slot is defined by two legs and the holding means is a locking arm pivotally attached to one leg and positioned between the plate and the plug. The outlet is a conventional two-socket outlet, the plug is a conventional two-prong plug, and the retainer portion has two prongs.

The device is easily used and holds the plug firmly in place. No tools are required. Removal of the plug is possible only by a person, such as an adult (but not a child), with sufficient coordination and strength.

Other features and advantages of the invention will be apparent from the following description of the preferred embodiment and from the claims.

DESCRIPTION OF THE PREFERRED EMBODIMENT

The drawings will first briefly be described.

DRAWINGS

STRUCTURE

Figure 1:
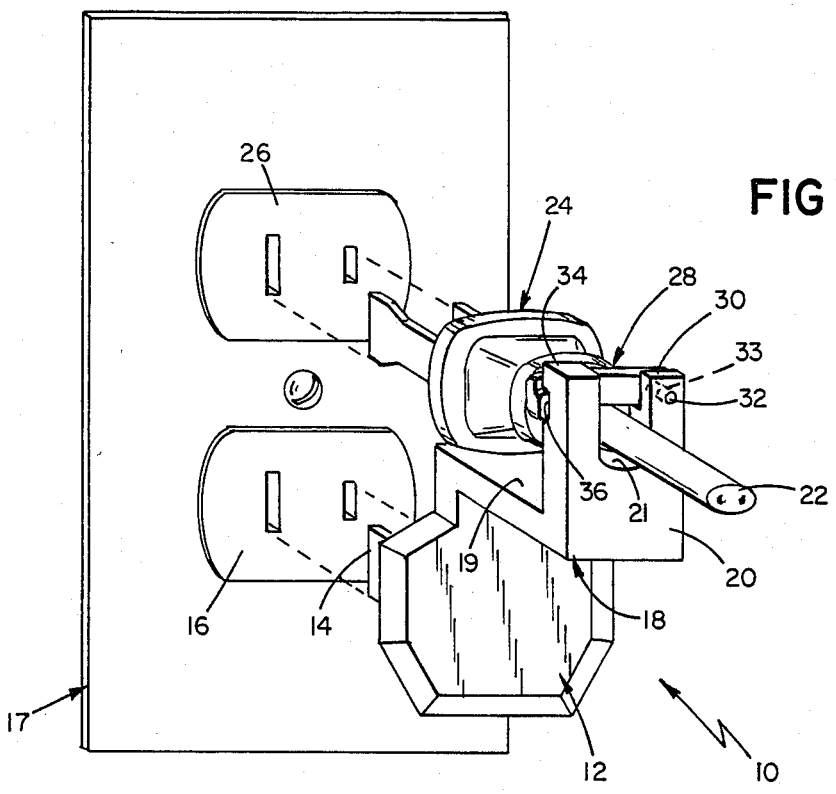
FIG. 1 is a perspective view of an outlet, a plug, and a safety device.

Referring to the figures, device 10 includes a retainer 12 having two prongs 14 for insertion into one socket 16 of a conventional two-socket electrical outlet 17. Retainer 12 also has an arm 18 that includes a plate 20 and a spanning section 19 that is perpendicular both to retainer 12 and to plate 20. Plate 20 has a slot 21 for positioning around an electrical cord 22. Plug 24 (attached to cord 22) is a conventional electrical plug shown in position to be inserted into the other socket 26 of the electrical outlet 17. Slot 21 is defined by two legs 30, 34 of plate 20. A locking arm 28 is pivotally attached to one leg 30 of plate 20, by a pin 32 that passes through a hole 33 in leg 30 and fits tightly by friction in a corresponding hole 35 in arm 28. Arm 28 is held securely by the second leg 34 when a ridge 37 on arm 28 is positioned in a notch 36 of leg 34. Arm 28 is positioned between plate 20 and plug 24 and that location combined with the ridge-notch locking mechanism makes the attachment of device 10 on cord 22 child-proof.

MANUFACTURE

Device 10 is made of a rigid plastic material, such as polyvinylchloride, using a single mold (except for arm 28 and pin 32, which must be molded separately). Preferably retainer 12, spanning section 19, and plate 20 are all at least 3 mm thick. Locking arm 28 is attached by pushing pin 32 through the two holes 33 and 35 in arms 30 and 28.

USE

Figure 2:
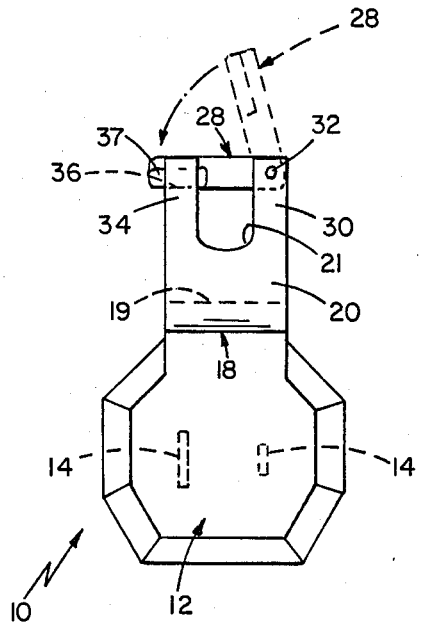
FIGS. 2 and 3 are front and side views, respectively, of the safety device.
Figure 3:
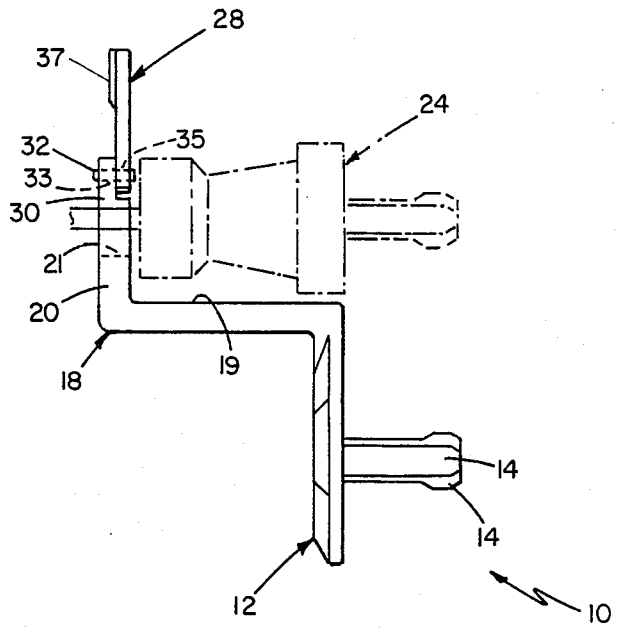

Plug 24 is first inserted into socket 26 without device 10. Arm 28 is swung open to the position 28 shown in dashed line in FIG. 2. Plate 20 is slipped over cord 22 with the cord seated in notch 21 but at a distance from plug 24. Arm 28 is closed and locked using ridge 37. Retainer 12 is then slid along cord 22 toward plug 24 while prongs 14 are inserted into the empty socket 16, until the prongs 14 are fully inserted and the inner surface of plate 21 bears against the end surface of plug 24. Prongs 14 fit tightly into socket 16, holding both device 10 and plug 24 firmly in position and covering socket 16. A child, lacking the dexterity to remove the assembled plug 24 and device 10 from outlet 10, is protected from electric shock.

Other embodiments are within the following claims. For example: the plug could be a conventional three-prong grounded plug.

I claim:

1. A device for resisting the removal of an electrical plug from one socket of an electrical outlet of the kind that has a plurality of sockets, said device comprising:

a retainer portion having at least one prong for insertion into a second said socket, said prong cooperating with said second socket to resist removal of said retainer portion, and an arm portion connected to said retainer portion and arranged to obstruct removal of said electrical plug from said one socket, said arm portion having sufficient rigidity to prevent removal of said electrical plug except by also removing said retainer portion.

2. The device of claim 1 wherein said electrical plug comprises a surface facing away from said outlet, and said arm portion has a surface that faces said outlet and cooperates with said electrical plug surface to obstruct said removal.

3. The device of claim 1 wherein said prong is held tightly by friction in said second socket.

4. The device of claim 1 wherein said arm portion includes a plate that has a slot for seating a cord attached to said plug and a means for holding said cord in said slot.

5. The device of claim 4 wherein said slot is defined by two legs, and said holding means is a locking arm pivotally attached to one said leg.

6. The device of claim 4 wherein said holding means is positioned between said plate and said plug.

7. The device of claim 1 wherein said outlet is a conventional two-socket outlet, and said plug is a conventional two-prong plug.

8. The device of claim 1 wherein said retainer portion comprises two said prongs.

* * * * *